US005360347A

United States Patent [19]

Irlbeck et al.

[11] Patent Number: 5,360,347

[45] Date of Patent: Nov. 1, 1994

[54] LAMINATED SURFACE MOUNT INTERCONNECTION SYSTEM

[75] Inventors: Robert D. Irlbeck, Greensboro; Warren A. Bates, Winston-Salem, both of N.C.

[73] Assignee: The Whitaker Corporation, Wilmington, Del.

[21] Appl. No.: 78,911

[22] Filed: Jun. 17, 1993

[51] Int. Cl.[5] ..... H01R 23/68

[52] U.S. Cl. ..... 439/66; 439/67

[58] Field of Search ..... 439/66, 67, 77, 91, 439/493, 591

[56] References Cited

U.S. PATENT DOCUMENTS 3,998,513 12/1976 Kobayashi et al. ..... 439/91
4,118,092 10/1978 Sado et al. ..... 439/91
4,402,562 9/1983 Sado ..... 439/66
4,955,818 9/1990 Strange et al. ..... 439/66

*Primary Examiner*—Gary F. Paumen
*Attorney, Agent, or Firm*—William B. Noll

[57] ABSTRACT

A compressible connector assembly which employs a plurality of discrete compressible connectors (10-1 . . .n) bonded together in an array and arranged within a simplified frame housing (12). The bonded structure securely adheres discrete compressible connectors (10-1 . . .n) together using intermediate spacers (14-1 . . .n) which minimize the risk of shorts. In addition, the connector assembly eliminates the expensive conventional molded framework (FIG. 1) which is required in existing compressible connector assemblies, and it facilitates close-pitch connections having tighter centerlines than possible in the prior art.

8 Claims, 2 Drawing Sheets

Fig. 1
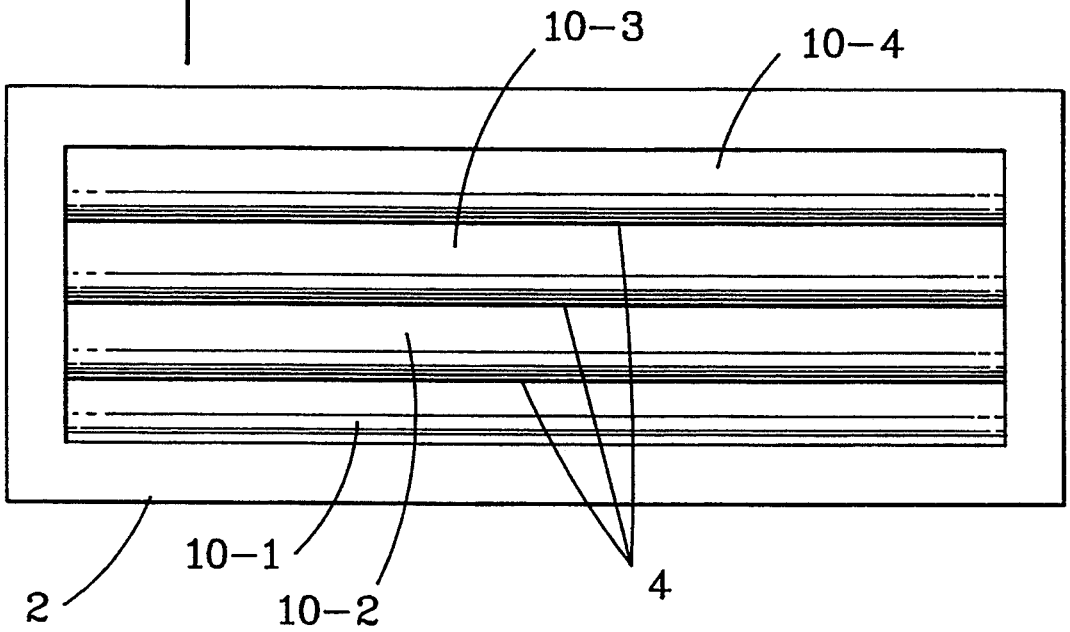
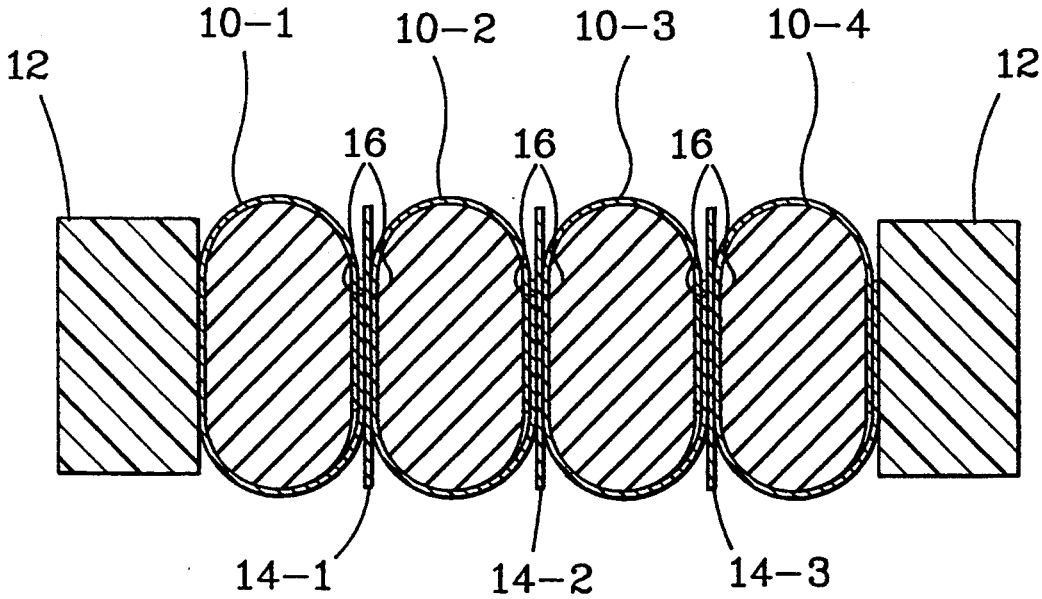
Fig. 2

LAMINATED SURFACE MOUNT INTERCONNECTION SYSTEM

CROSS-REFERENCE TO RELATED APPLICATION(S)

The present application is related to co-pending patent application Ser. No. 07/954,173, now U.S. Pat. No. 5,277,593, granted Jan. 11, 1994, entitled "COMPRESSIBLE ELECTRICAL CONNECTORS FOR LARGE BOARD SPACINGS" and co-pending patent application Ser. No. 08/012,170, now U.S. Pat. No. 5,313,368, granted May 17, 1994, entitled "ELECTRICAL CONNECTIONS BETWEEN PRINTED CIRCUIT BOARDS AND INTEGRATED CIRCUITS SURFACE MOUNTED THEREON."

FIELD OF THE INVENTION

The present invention relates to electrical connectors and, more particularly, to a compressible connector assembly to be interpositioned between two electrical devices for interconnecting their respective circuit elements.

BACKGROUND OF THE INVENTION

The field of electronics is rapidly moving toward higher-density devices with tighter arrangements of circuit traces and contact terminals. To keep pace, the connectors which join such devices must do so with extremely tight side-by-side arrays of contact terminals. However, it remains a perplexing problem to reduce spacing (i.e., "pitch") of the connector assembly without sacrificing the strength, durability, reliability, and ease of assembly.

Compressible connector assemblies offer a solution. As a result, they are widely used in the computer, electronics, and aerospace industries. Generally, compressible electrical connectors comprise a plurality of conductive traces integrally formed along a flexible member. There are numerous commercially available examples. For instance, certain compressible connectors have conductive traces formed directly on silicon rubber. Other compressible connectors are formed of layers of carbon conductive silicon alternately laminated between layers of non-conductive silicon.

One particular example of a commercially available compressible electrical connector is supplied by AMP Incorporated of Harrisburg, Pa. under the brand "AMPLIFLEX" ®. AMPLIFLEX ® connectors incorporate a thin flexible polyamide film on which individual conductive traces are etched. This flexible circuit is wrapped around a silicone rubber core. These connectors are well suited to high density, surface mount applications. They accommodate short-range surface variations of several thousandths of an inch; transmit high frequency signals with very little distortion; can offer redundant electrical contact paths; and they allow generous tolerances for alignment purposes. In addition, they provide the following capabilities:

- the ability to interconnect contact arrays with pitch spacings as small as 0.010 inch;
- low clamping forces for high pin-count connectors;
- controlled impedance paths;
- solderless assembly; and
- high shock and vibration tolerance.

In a typical product application, an array of AMPLIFLEX ® compressible connectors is positioned and held in place by a housing such as shown in FIG. 1. The illustrated housing includes a molded outer frame 2 supporting an array of integrally-molded support rails 4 each for carrying a corresponding AMPLIFLEX ® compressible connector. Any number of AMPLIFLEX ® compressible connectors may be arranged side-by-side and support rails 4 define connector "centerlines." The centerlines must be tightly-packed in order to interconnect contacts having close pitch spacings. Tight centerlines are difficult to accomplish given the considerable width of AMPLIFLEX ® and other compressible connectors. In order to reduce the spacing of the centerlines, the width of the support rails 4 must likewise be reduced.

Given a very close pitch spacing constraint, the housing of FIG. 1 will inevitably be a very intricate structure. At best, the intricacy leads to additional costs throughout the molding and assembly process. At worst, the support rails 4 must be so thin in comparison to the outer frame 2 that the structure is impossible to mold.

It would be highly desirable to simplify the housing and thereby reduce the engineering and production problems which result in increased costs.

SUMMARY OF THE INVENTION

It is, therefore, an object of the present invention to provide an improved compressible connector assembly which employs a plurality of discrete compressible connectors bonded together in an array.

It is a further object to incorporate the above-described bonded array in simplified housing, thereby eliminating the expensive molded framework of parallely-arranged support rails in existing compressible connector assemblies.

It is another object to reduce the centerline pitch spacing in a compressible connector array, thereby facilitating tighter connections than are possible with existing technology.

It is still another object to provide a laminated bond to securely adhere discrete compressible connectors together while minimizing the risk of shorts therebetween.

In accordance with the above-described and other objects, the present invention provides a connector assembly for connecting circuit elements of a first electronic device to respective circuit elements of a second electronic device. The connector assembly comprises a housing which frames a central opening. In addition, a plurality of compressible connectors is bonded together across the central opening of the housing.

Each compressible connector further includes an elongate elastomeric core member and a flexible circuit wrapped around the core member. The flexible circuit bears conductive circuit traces which are exposed on opposite sides of the housing.

Each pair of adjacent compressible connectors is electrically insulated by a non-conductive spacer, and the compressible connectors are bonded together by a layer of adhesive bonding one compressible connector to the spacer, and a layer of adhesive bonding the spacer to the adjacent compressible connector.

When sandwiched between the first and second circuit devices, the connector assembly completes multiple electrical connections therebetween via the circuit traces of the compressible connectors.

Other advantages and results of the invention are apparent from a following detailed description by way of example of the invention and from the accompanying drawings.

BRIEF DESCRIPTION OF DRAWINGS

FIG. 1 is a front view of an existing housing 2 with integrally molded latticework 4 for supporting an array of AMPLIFLEX ® compressible connectors.

FIG. 2 is a cross-sectional view of a bonded compressible connector assembly according to the present invention.

DETAILED DESCRIPTION OF THE PREFERRED EMBODIMENT

With more particular reference to the drawings, FIG. 2 is a side cross-section of a compressible electrical connector assembly according to the present invention.

The compressible connector assembly includes an outer frame 12 which defines a central opening for therein supporting a central array of compressible connectors 10-1 . . . n.

The discrete compressible connectors 10-1 . . . n are bonded together across the central opening of the outer frame 12. The compressible connectors 10-1 . . . n may be arranged in multiple rows across the outer frame 12, and the size of the outer frame 12 and the number of compressible connectors 10-1 . . . n therein may vary depending on the particular application.

Figure 3:
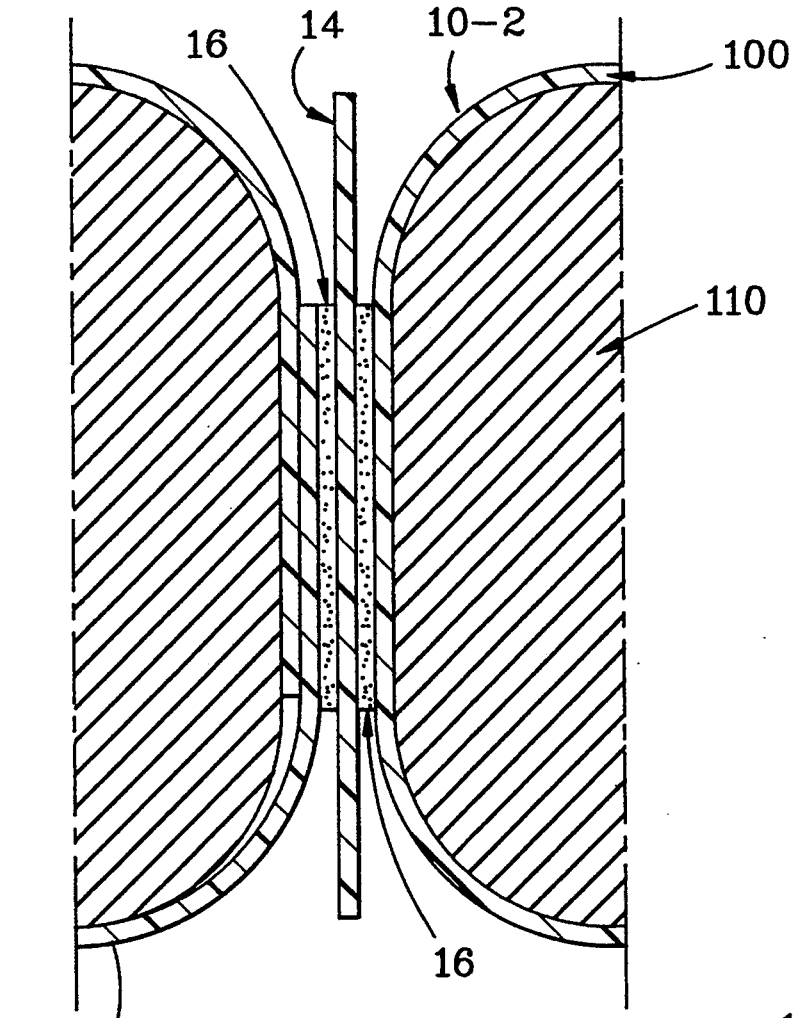
FIG. 3 is an exploded cross-section of a pair of bonded compressible connectors 10-1 and 10-2 as in FIG. 2.

FIG. 3 is an enlarged illustration of a bonded pair of compressible connectors 10-1 and 10-2 as in FIG. 2. Each compressible connector 10-1 and 10-2 further comprises an elongate elastomeric core member 110 and a flexible circuit 100 wrapped around the core member 110. The illustrated compressible connectors 10-1 and 10-2 are presently available from AMP Incorporated of Harrisburg, Pa. under its trademark "AMPLIFLEX". However, it should be understood that a wide variety of other compressible connectors is available and is suitable for use in accordance with the present invention, and all are considered to be within the scope of the invention.

With AMPLIFLEX ®, the circuitry on each flexible circuit 100 is etched or otherwise printed on a suitable flexible film substrate. Hence, the flexible circuit 100 bears the appropriate circuitry thereon for completing multiple electrical connections between the top and bottom of the compressible connector 10. The flexible circuit 100 is retained on the core member 110 by conventional means, such as an interlocking overlapping section (as shown).

The elastomeric core members 110 are preferably extruded from a suitable silicone rubber compound having a high temperature and low compression set.

The resilient core member 110 exerts a substantially-constant resilient bias, thereby providing a "cushion" for the flexible circuit 100. This provides the force necessary to maintain contact, and it helps to take up tolerances existing between the electrical devices to be connected.

Multiple connections occur along the length of each compressible connector 10-1 . . . n. Since the pitch spacing between connections may be very small, a very high density of connections is possible.

In accordance with the present invention, a non-conductive spacer 14 is interposed between adjacent compressible connectors 10-1 and 10-2 to provide electrical insulation therebetween, and a layer of adhesive 16 bonds each compressible connector 10-1 and 10-2 to the non-conductive spacer 14.

The non-conductive spacers 14 may be formed from any thin non-conductive material. For instance, silicon based plastic such as DuPont Kapton ® is well-suited.

The adhesive may likewise be a silicone-based composition to improve the resiliency, durability, and thermal properties of the bond.

By use of a bonded array of compressible connectors 10-1 . . . n as described above, any number of compressible connectors 10-1 . . . n may be arranged in multiple rows to suit any particular application. It is only necessary to support the periphery of the array within an outer frame, and the integrally molded latticework 4 of FIG. 1 is unnecessary.

Figure 4:
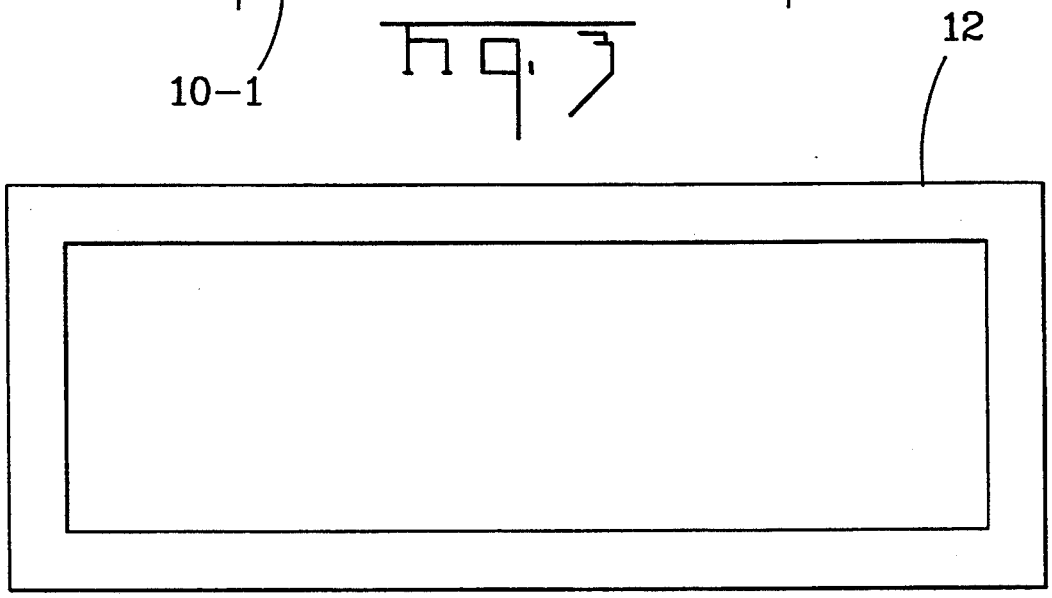
FIG. 4 is a front view of a simplified housing 12 which is suited for supporting a bonded array of compressible connectors 10-1 . . . n according to the present invention.

Consequently, a simplified frame 12 as shown in FIG. 4 is perfectly suitable for supporting an entire bonded array of compressible connectors 10-1 . . . n. Frame 12 is simple in structure and may be molded from any suitable material, such as a plastic or other polymer. Hence, manufacturing and assembly is much less expensive.

The frame 12 and bonded array of compressible connectors 10-1 . . . n supported thereby may be sandwiched between two electrical devices for completing numerous electrical connections therebetween. For example, the compressible connector assembly of the present invention is especially suitable for interconnecting a lead-less integrated circuit with a surface mount printed circuit board.

The electrical devices are then fastened together by conventional means such as screws, rivets, pylons or the like.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

We claim:

1. A connector assembly for connecting circuit elements of a first electronic device to respective circuit elements of a second electronic device, said connector comprising:

a housing framing a central opening;

a plurality of compressible connectors bonded together and arrayed side-by-side in rows across the central opening of said housing; and a plurality of non-conductive spacers each adhered between a bonded pair of said compressible connectors for providing electrical insulation therebetween;

whereby said connector assembly may be sandwiched between said first and second electronic devices to complete multiple electrical connections therebetween via said compressible connectors.

2. The connector assembly according to claim 1 wherein adjacent compressible connectors are bonded together by a first adhesive layer between one compressible connector and said non-conducting spacer, and by a second adhesive layer between the adjacent compressible connector and said non-conducting spacer.

3. The connector assembly according to claim 1 wherein said housing is a rectilinear frame and that said central opening is defined thereby as an uninterrupted rectilinear central opening.

4. The connector assembly according to claim 1 wherein said plurality of non-conductive spacers is formed from non-conductive plastic.

5. The connector assembly according to claim 4 wherein said non-conductive plastic is silicon-based plastic.

6. The connector assembly according to claim 1 wherein said plurality of compressible connectors and said plurality of non-conductive spacers are bonded with a silicon-based glue.

7. The connector assembly according to claim 1 wherein said first electronic device is a lead-less integrated circuit, and said second electronic device is a surface-mount printed circuit board.

8. A connector assembly for connecting circuit elements of a first electronic device to respective circuit elements of a second electronic device, said connector comprising:

a housing framing a central opening;

a plurality of compressible connectors bonded together across the central opening of said housing, said compressible connectors each further comprising an elongate elastomeric core member and a flexible circuit wrapped around said core member to expose conductive circuit traces on opposing sides of said housing; and a plurality of non-conductive spacers each adhered between a bonded pair of said compressible connectors for providing electrical insulation therebetween;

whereby said connector assembly may be sandwiched between said first and second electronic devices to complete multiple electrical connections therebetween via said compressible connectors.

* * * * *